US009609949B2

(12) United States Patent
Lee

(10) Patent No.: US 9,609,949 B2
(45) Date of Patent: Apr. 4, 2017

(54) CHAIR CAPABLE OF INTERLOCKING BACK SUPPORT AND FOOTREST

(71) Applicant: Sang Hwa Lee, Gimhae-shi (KR)

(72) Inventor: Sang Hwa Lee, Gimhae-shi (KR)

( * ) Notice: Subject to any disclaimer, the term of this patent is extended or adjusted under 35 U.S.C. 154(b) by 0 days.

(21) Appl. No.: 14/887,576

(22) Filed: Oct. 20, 2015

(65) Prior Publication Data

US 2016/0037926 A1 Feb. 11, 2016

Related U.S. Application Data

(63) Continuation of application No. PCT/KR2014/002527, filed on Mar. 25, 2014.

(30) Foreign Application Priority Data

Apr. 23, 2013 (KR) ..... 10-2013-0044540

(51) Int. Cl.

| | |
|---|---|
| ***A47C 7/50*** | (2006.01) |
| ***A47C 20/00*** | (2006.01) |
| ***A47C 20/16*** | (2006.01) |
| ***A47C 1/024*** | (2006.01) |
| ***A47C 1/032*** | (2006.01) |
| ***A47C 1/035*** | (2006.01) |

(Continued)

(52) U.S. Cl.

CPC ..... *A47C 1/0355* (2013.01); *A47C 1/03* (2013.01); *A47C 1/036* (2013.01); *A47C 1/037* (2013.01); *A47C 1/0352* (2013.01); *A47C 1/03233* (2013.01); *A47C 1/03255* (2013.01); *A47C 1/03294* (2013.01)

(58) Field of Classification Search

CPC ... A47C 1/03; A47C 1/03233; A47C 1/03255; A47C 1/0355; A47C 1/036; A47C 1/037; A47C 1/0352; A47C 1/03294

USPC ..... 297/69–91, 317, 318, 340, 341, 342, 297/423.2, 423.21, 423.22, 423.23, 297/423.24, 423.26, 423.28, 423.3

See application file for complete search history.

(56) References Cited

U.S. PATENT DOCUMENTS 2,627,898 A * 2/1953 Jackson ..... A47C 1/03294 297/342
3,863,980 A * 2/1975 Ciner ..... A47C 1/035 297/342

(Continued)

FOREIGN PATENT DOCUMENTS

JP 6-245838 A 9/1994
JP 06245838 A * 9/1994

(Continued)

OTHER PUBLICATIONS

WIPO, International Search Report (PCT/KR2014/002527), Apr. 29, 2014.

*Primary Examiner* — Rodney B White
(74) *Attorney, Agent, or Firm* — Park & Associates IP Law, P. C.

(57) ABSTRACT

Disclosed in this application is a chair capable of permitting a user to quickly and easily change his or her posture by tilting a back support in a state in which the user takes a seat. The chair includes a seat support; a back support which has a back frame, with a lower end being connected to a rear end of the seat support by a pivot shaft, so that the back support is tilted in a rearward direction; and a footrest which is engaged to the seat support, so that the back support is interlocked with the footrest.

7 Claims, 9 Drawing Sheets

(51) Int. Cl.

| | |
|---|---|
| ***A47C 1/0355*** | (2013.01) |
| ***A47C 1/03*** | (2006.01) |
| ***A47C 1/036*** | (2006.01) |
| ***A47C 1/037*** | (2006.01) |

(56) References Cited

U.S. PATENT DOCUMENTS

| | | | | |
|---|---|---|---|---|
| 4,470,634 | A * | 9/1984 | Delius | B60N 2/0292 297/423.26 X |
| 4,861,106 | A * | 8/1989 | Sondergeld | A47C 1/03238 297/316 X |
| 5,039,167 | A * | 8/1991 | Sweet | A47C 1/04 297/423.28 |
| 5,259,664 | A * | 11/1993 | Cottle | A61G 5/12 297/423.26 |
| 5,362,128 | A * | 11/1994 | Wildern, IV | B60N 2/62 297/423.26 X |
| 5,782,535 | A * | 7/1998 | Lafer | A47C 1/0342 297/423.28 |
| 5,967,609 | A * | 10/1999 | Potter | A47C 1/027 297/325 X |
| 7,229,134 | B2 * | 6/2007 | Ito | B60N 2/0232 297/423.26 |
| 7,611,207 | B2 * | 11/2009 | Barfuss | A47C 1/06 297/423.2 |
| 8,534,758 | B2 * | 9/2013 | Rivera | A47C 1/03294 297/342 |
| 8,534,762 | B2 * | 9/2013 | Linhoff | A47C 7/506 297/423.26 |
| 8,646,842 | B2 * | 2/2014 | Barfuss | A47C 1/10 297/423.2 X |
| 8,870,289 | B2 * | 10/2014 | Yin | A47C 7/506 297/423.2 |
| 2008/0217982 | A1 * | 9/2008 | Parkel | A47C 7/50 297/423.28 |
| 2009/0273220 | A1 * | 11/2009 | Kim | B60N 2/0232 297/423.28 |
| 2011/0001343 | A1 * | 1/2011 | Ellison | B60N 2/3013 297/340 |
| 2015/0021969 | A1 * | 1/2015 | Yin | B64D 11/0643 297/423.26 |
| 2015/0284087 | A1 * | 10/2015 | Henshaw | B64D 11/064 297/340 X |

FOREIGN PATENT DOCUMENTS

| | | | |
|---|---|---|---|
| JP | 2002-302099 | A | 10/2002 |
| JP | 2012-147850 | A | 8/2012 |
| JP | 2012-179214 | A | 9/2012 |
| KR | 10-1171245 | B1 | 8/2012 |

* cited by examiner

CHAIR CAPABLE OF INTERLOCKING BACK SUPPORT AND FOOTREST

REFERENCE TO RELATED APPLICATIONS

This is a continuation of pending International Patent Application PCT/KR2014/002527 filed on Mar. 25, 2014, which designates the United States and claims priority of Korean Patent Application No. 10-2013-0044540 filed on Apr. 23, 2013, the entire contents of which are incorporated herein by reference.

FIELD OF THE INVENTION

The present invention relates to a chair capable of interlocking a back support and a footrest.

More particularly, the present invention relates to a chair which is configured to permit a back support to move backward simultaneously with forward movement of a footrest for stretching of user's feet, thereby improving convenience of the user.

BACKGROUND OF THE INVENTION

FIG. 1 shows the configuration of a chair according to the related art, for example, disclosed in the publication of Korea Utility Model Registration No. 20-0301444.

Referring to FIG. 1, the chair of the related art includes a seat 1, a lumber support 2, and a footrest 3.

The back support 2 is configured to tilt in a rearward direction by rotation of a handle 5, and the footrest 3 is configured to independently adjust an angle thereof by another handle 7.

With the configuration of the chair according to the related art, in order to change the angle of the chair for a comfort state in which the user stretches his or her feet, any operator, such as the handles 5 and 7, should be manipulated so that the back support 2 is tilted in the rearward direction and the angle of the footrest 3 is changed. However, it is not easy to manipulate the operator in the state in which the user takes a seat.

In order to solve the above drawback, an electrically-powered device capable of automatically operating the actuators should be provided. However, the electrically-powered device causes the weight of the chair to increase, which pressures on carrying it and leads to increase its manufacturing costs.

SUMMARY OF THE INVENTION

Accordingly, an object of the present invention is to provide a chair capable of permitting a user to quickly and easily change his or her posture by tilting a back support in a state in which the user takes a seat, without having an electrically-powered device, thereby improving convenience of the user.

To accomplish the above-mentioned object, according to a first aspect of the present invention, there is provided a chair capable of interlocking a back support and a footrest, the chair including: a seat support; a back support which has a back frame, with a lower end being connected to a rear end of the seat support by a pivot shaft, so that the back support is tilted in a rearward direction; and a footrest which is engaged to the seat support, the seat support including a base plate, a first sliding member which is slid back and forth on the base plate and is provided with first rack gears in a sliding direction, intermediate gears which have rotating shafts installed to the base plate and are meshed with the first rack gears, and second sliding members which are slid back and forth on the base plate and are provided with second rack gears to be meshed with the intermediate gears so that the second sliding members are slid in a direction opposite to the first sliding member, the footrest including a foot strap which is engaged to a front end of the first sliding member, and is positioned below a front portion of the seat support, and the back support including link members which are installed at sides of the seat support, with upper ends of the link members being pivotally connected to the back frame at an upper side of the pivot shaft, and lower ends thereof being pivotally connected to the second sliding members, so that the back support is interlocked with the footrest.

Also, according to the present invention, the back frame has a pair of support rods which are disposed in parallel at both sides of the back support in a vertical direction, and an upper end connecting rod for connecting upper ends of the pair of support rods, the back support includes a sliding frame which is slid along the support rods in a vertical direction, connecting rods which are connected to a lower portion of the sliding frame, with lower ends of the connecting rods being restrained to the base plate by pin connection at a forward position relative to a lower end of the back frame, and spring members which are installed to the sliding frame and the upper end connecting rod at both ends thereof to pull the sliding frame toward the upper end connecting rod.

In addition, according to the present invention, the base plate is provided with a plurality of rollers which is brought into contact with a bottom surface of the first sliding member to assist sliding movement of the first sliding member, and a top surface of the base plate is provided with rails in a longitudinal direction so that the second sliding members are moved back and forth along the rails, and a stopper for restricting rearward movement of the first sliding member within a preset range.

In addition, according to the present invention, the sliding frame is provided with a back plate for supporting an upper body of a user, and armrests installed to both sides of the sliding frame, and the back plate and the armrests are moved together with the sliding frame.

In addition, according to the present invention, a connecting portion between the connecting rod and the sliding frame is provided with an adjuster for adjusting a position of the connecting rod to be connected to the sliding frame, thereby adjusting a height of the sliding frame.

In addition, according to the present invention, a reading desk support is respectively installed to both sides of the seat support, and includes a standing support member with a lower end fixed to the seat support, and a three-stage link board installed to an upper end of the support member, the three-stage link board is arranged in such a way that a longitudinal direction thereof faces a forward/rearward direction, and has a first-stage link board which is fixed to the upper end of the support member, a second-stage link board with one end pivotally connected to a first link shaft which is installed to a front end of the first-stage link board, and a third-stage link board with one end pivotally connected to a second link shaft which is installed to the other end of the second-stage link board, and the third link board of the respective reading desk supports is formed with a plurality of through-holes at desired intervals.

With the configuration of the present invention, in a case where the sitting user wants to tilt the back support in the rearward direction in a state in which his or her feet are put on a foot strap, the user can quickly change his or her sitting posture to the comfortable posture by stretching his or her feet in the forward direction and applying the weight to the back support. The reason is that the footrest and the back support are interlocked with each other by the first sliding member, the second sliding members, and the link members, and thus the whole operation occurs simultaneously.

In addition, the chair according to the present invention includes the sliding frame which is slid along the support rods in the vertical direction, the connecting rods for connecting the lower portion of the sliding frame to the seat frame by pin connection, and the spring members for pulling the sliding frame toward the upper end connecting rod. Therefore, in the state in which the back support is tilted in the rearward direction, and the foot strap is moved in the forward direction, when the user raises his or her upper body, the chair can be quickly returned to its original position. That is, when the load applied to the back support is eliminated or decreased, the sliding frame is slid upwardly by the resilience of the spring members, and thus the back support is returned. Also, the foot strap is returned to its original position with the movement of the back support.

Also, in the process of tilting the back support in the rearward direction, it is possible to adjust a slope of the back support by adjusting the force of pulling the foot strap and the stretching distance of the leg.

In addition, since both armrests are connected to the sliding frame to be moved together with the sliding frame, if the back support is tilted in the rearward direction, the armrests are also tilted together with the upper body of the user. There is little change in distance between the upper body and the armrests and angle between the upper body and the armrests. Therefore, the user draping his or her arms on the armrest feels comfort in the state in which the back support is tilted in the rearward direction.

In addition, since the chair is provided with the reading table supports, a reading desk can be easily installed in front of the sitting user, or a book can be easily supported in front of the sitting user.

DETAILED DESCRIPTION OF THE INVENTION

Hereinafter, a preferred embodiment of the present invention will be described in detail with reference to the accompanying drawings.

Figure 1:
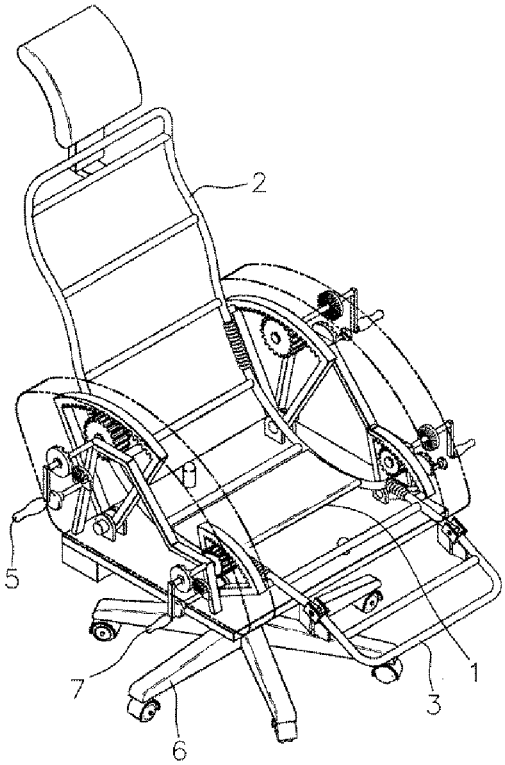
FIG. 1 is a view illustrating the configuration of a chair according to the related art.
Figure 2:
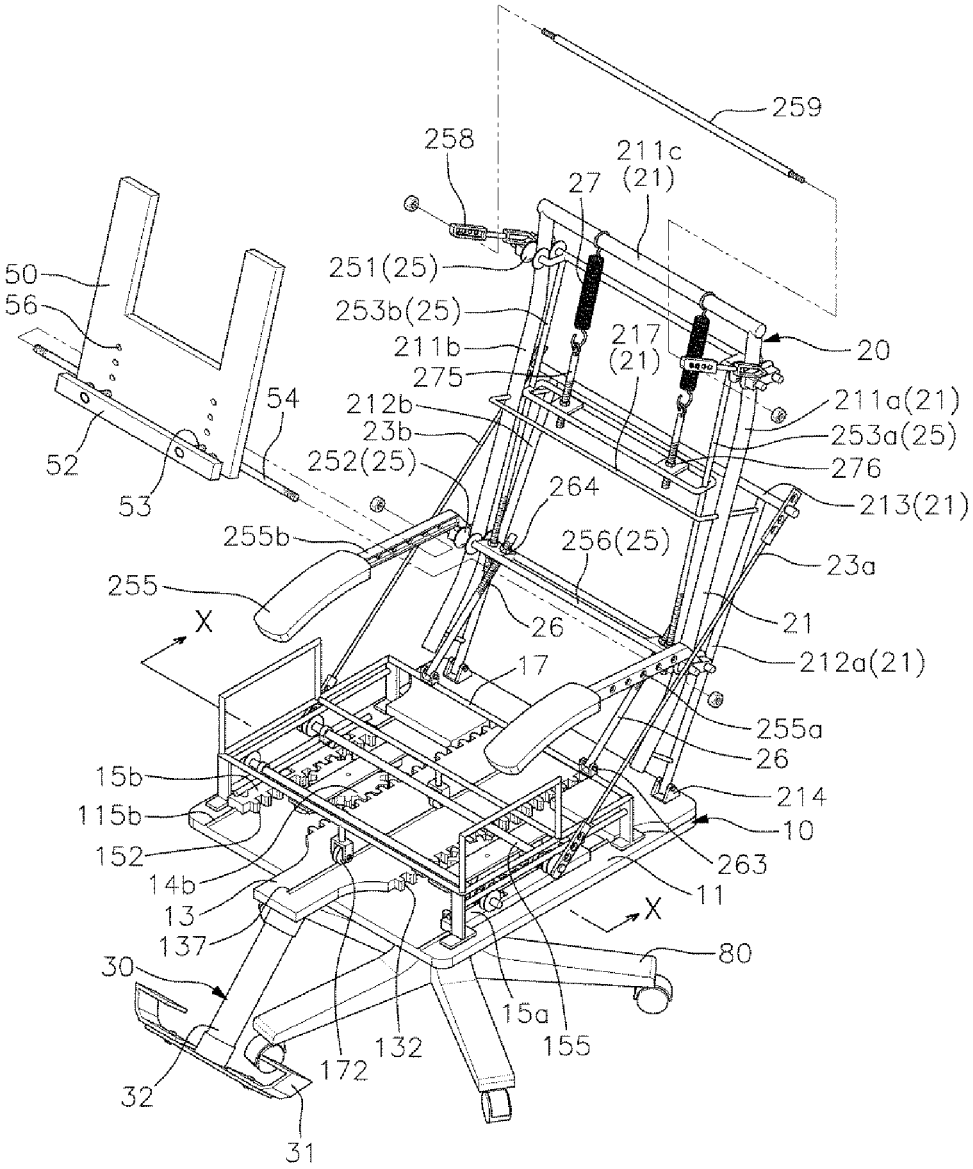
FIG. 2 is a perspective view illustrating a chair capable of interlocking a back support and a footrest according to one embodiment of the present invention.
Figure 3:
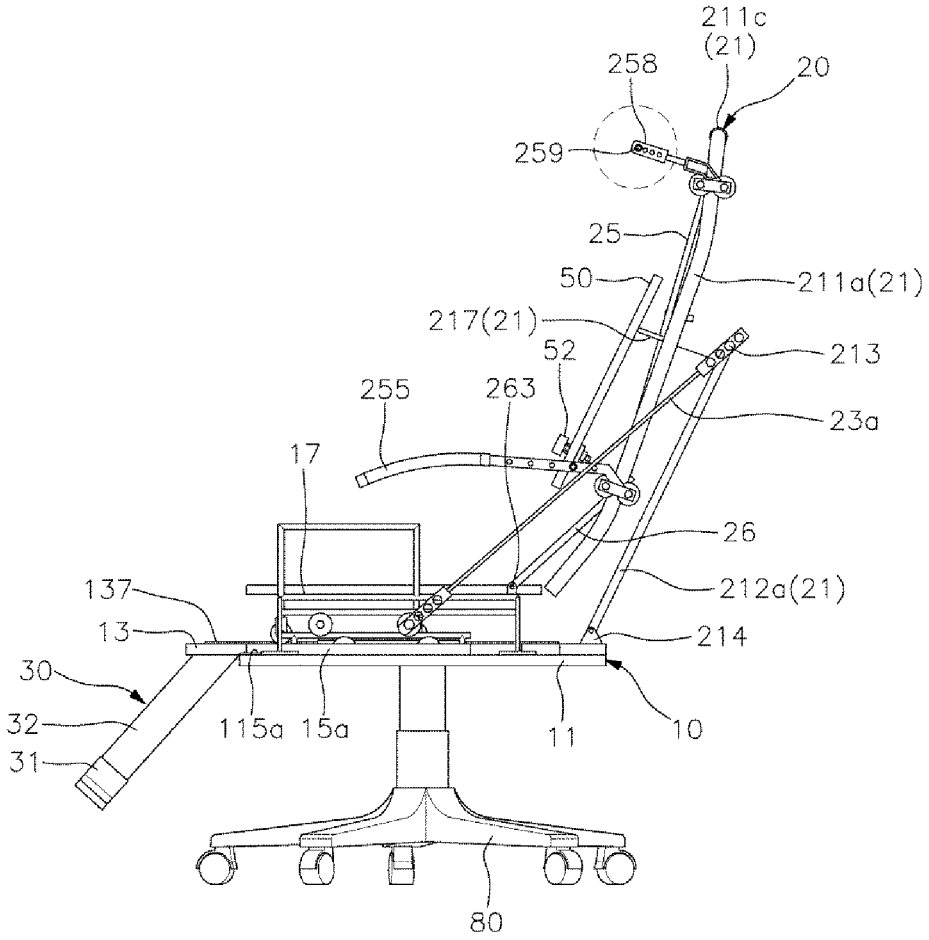
FIG. 3 is a side view illustrating the chair capable of interlocking the back support and the footrest according to one embodiment of the present invention.
Figure 4:
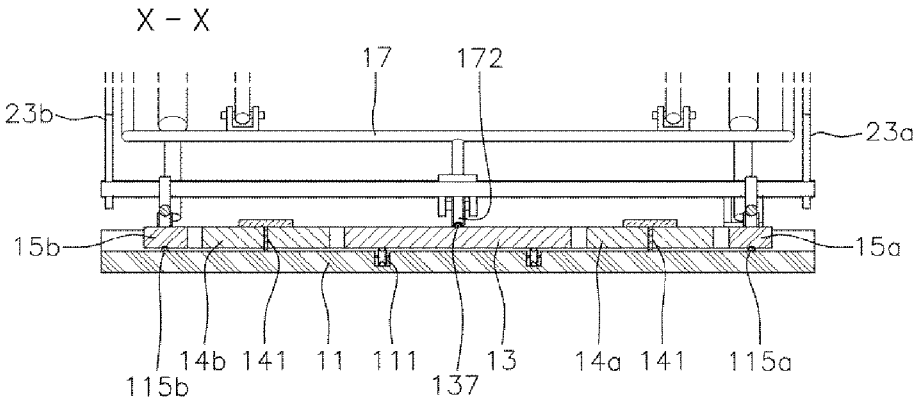
FIG. 4 is a cross-sectional view illustrating the configuration of a seat support in the chair capable of interlocking the back support and the footrest according to one embodiment of the present invention.

FIG. 2 is a perspective view illustrating a chair capable of interlocking a back support and a footrest according to one embodiment of the present invention. FIG. 3 is a side view illustrating the chair capable of interlocking the back support and the footrest according to one embodiment of the present invention. FIG. 4 is a cross-sectional view illustrating the configuration of a seat support in the chair capable of interlocking the back support and the footrest according to one embodiment of the present invention.

Referring to FIGS. 2 to 4, a chair according to one embodiment of the present invention includes a seat support 10, a back support 20 which has a back frame 21, with a lower end being connected to a rear end of the seat support 10, so that the back support 20 can be tilted in a rearward direction, and a footrest 30 which is engaged to the seat support 10, in which the back support 20 is interlocked with the footrest 30. Also, some legs 80 are provided below the seat support 10 to support the seat support 10.

The seat support 10 includes a base plate 11, a first sliding member 13 which is slid back and forth on the base plate 11 and is provided with first rack gears 132 in a sliding direction, intermediate gears 14*a* and 14*b* which have rotating shafts 141 installed to the base plate 11 and are meshed with the first rack gears 132, and second sliding members 15*a* and 15*b* which are slid back and forth on the base plate 11 and are provided with second rack gears 152 to be meshed with the intermediate gears 14*a* and 14*b* so that the second sliding members are slid in the direction opposite to the first sliding member 13.

The base plate 11 is a plate to form a lower portion of the seat support 10, and the entire configuration of the seat support 10 is installed on the base plate 11.

The first sliding member 13 is a plate which is disposed at the center of a top surface of the base plate 11 and is slid back and forth. A bottom surface of the first sliding member 13 is brought into contact with and supported by a plurality of rollers 111 installed to the base plate, so that the first sliding member can be smoothly slid.

The first sliding member 13 is pressed by pressing rollers 172 of the seat frame 17, which are provided on the first sliding member, from an upward direction to prevent the first sliding member from being released in the upward direction. The top surface of the first sliding member 13 is provided with a rail 137 in a longitudinal direction, and the pressing rollers 172 are moved along the rail.

Each of the first rack gears 132 is provided on both sides of the first sliding member 13.

The intermediate gears 14*a* and 14*b* are meshed with and are driven by the first rack gears 132 of the first sliding member 13, and the rotating shaft 141 is installed to the base plate 11. Accordingly, the intermediate gears 14*a* and 14*b* meshed with the first rack gear are driven at a fixed position by linear movement of the first sliding member 13.

The second sliding gears 15*a* and 15*b* are provided with the second rack gears 152, which are meshed with the intermediate gears 14*a* and 14*b*, in the longitudinal direction, and are moved back and forth by rotation of the intermediate gears 14*a* and 14*b*. Accordingly, since the second sliding members are moved via the intermediate gears 14*a* and 14*b*, the moving direction of the first sliding member 13 is opposite to that of the second sliding members 15*a* and 15*b*.

Figure 5:
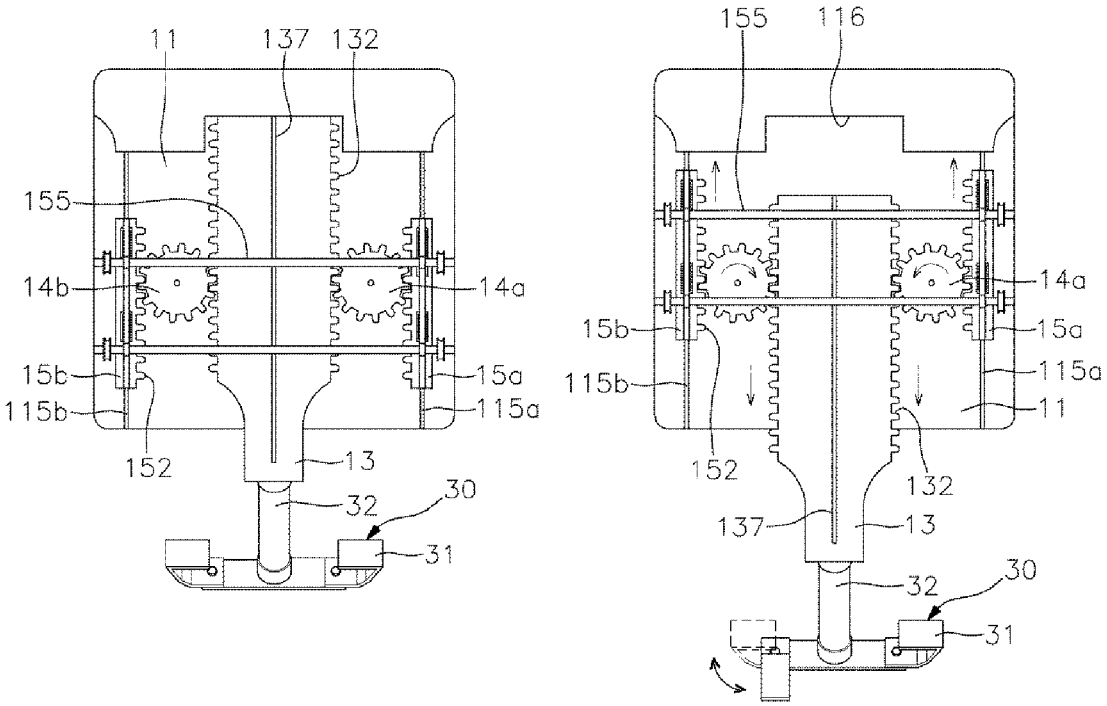
FIG. 5 is a view illustrating the operation of a first sliding member, intermediate gears, and second sliding members in the chair capable of interlocking the back support and the footrest according to one embodiment of the present invention.

FIG. 5 shows the operation thereof. If a user stretches his or her legs in a state in which the user puts his or her feet on the footrest 30, the first sliding member 13 moves forward, and the second sliding members 15*a* and 15*b* move backward.

The second sliding members 15*a* and 15*b* are moved back and forth along the rails 115*a* and 115*b* installed to the base plate 11, and the top plate of the base plate 11 is provided on a rear side with a stopper 116 to restrict the rearward movable distance of the first sliding member 13 by a set limit.

The second sliding members 15*a* and 15*b* are respectively fixed to both sides of connecting bars 155 at the upper portions thereof, such that the second sliding members 15*a* and 15*b* and the connecting bars 155 are simultaneously moved. Both ends of the connecting bars 155 are pivotally connected to link members 23*a* and 23*b* which will be described later, and thus the linear movement of the second sliding members 15*a* and 15*b* can be interlocked with and the tilting movement of the back support 20.

As described above, the first sliding member 13 and the second sliding members 15*a* and 15*b* can be slid in the opposite direction not via the intermediate gears 14*a* and 14*b*, but via a common link unit. For example, the first sliding member 13 is coupled to a slot formed in one end of a rod having a rotating shaft at a center portion which is installed to the base plate 11, and the second sliding members 15*a* and 15*b* are coupled to a slot formed in the other end thereof, so that the moving direction of one end is opposite to that of the other end on the basis of the rotating shaft.

The seat frame 17 fixed to the base plate 11 is installed on the first sliding member 13. The seat frame 17 supports the weight of the user who occupies the seat support 10, and provides an operating space to the first sliding member 13, the second sliding members 15*a* and 15*b*, and the intermediate gears 14*a* and 14*b*.

The footrest 30 includes a foot strap 31 which is engaged to a front end of the first sliding member 13, and is positioned below a front portion of the seat support 10.

The foot strap 31 is bent inwardly in such a way that the feet of the user rest on the foot strap, and a lower end of a support rod 32 is fixed to a center portion of the foot strap 31. An upper end of the support rod 32 is engaged to the front end of the first sliding member 13, and is extended downwardly at a desired angle from the front end of the first sliding member 13, so that the foot strap 31 is positioned below the front portion of the seat support 10.

Accordingly, if the user stretches his or her legs in the state in which the user puts his or her feet on the foot strap 31, the foot strap 31 moves forward, and also the first sliding member 13 moves forward.

Referring to FIGS. 2 and 3, the back support 20 includes a back frame 21, and link members 23*a* and 23*b* which are installed at sides of the seat support 10, with upper ends of the link members being pivotally connected to the back frame 21 at the upper side of the pivot shaft 214, and lower ends thereof being pivotally connected to the second sliding members 15*a* and 15*b*.

The back frame 21 is configured to form a framework of the back support 20, and has a pair of support rods 211*a* and 211*b* disposed in parallel at both sides of the back support 20 in a vertical direction, an upper end connecting rod 211*c* for connecting upper ends of the pair of support rods 211*a* and 211*b*, and a pair of connecting rods 212*a* and 212*b* fixed to the support rods 211*a* and 211*b* and connected to the base plate 11 of the seat support 10.

The pair of support rods 211*a* and 211*b* are fixed to the pair of connecting rods 212*a* and 212*b*, and lower ends of the connecting rods 212*a* and 212*b* are connected to the rear end of the seat support 10 by the pivot shafts 214. Therefore, the back frame 21 is pivoted around the pivot shaft 214, and thus the back support 20 is tilted in the rearward direction.

The pair of support rods 211*a* and 211*b* are disposed in parallel to each other, so that a sliding frame 25 which will be described later can be slid along the support rods 211*a* and 211*b*. An auxiliary support member 217 is horizontally fixed to the support rods 211*a* and 211*b*, so as to come into contact with a back plate 50 from the rear side and support the back plate 50.

The link members 23*a* and 23*b* are installed to the sides of the seat support 10. Preferably, the link members are respectively installed to both sides of the seat support 10. Each of the link members 23*a* and 23*b* is pivotally connected to the link connecting rod 213 of the back frame 21 at the upper ends thereof, and the lower ends of the link members 23*a* and 23*b* are pivotally connected to the second sliding members 15*a* and 15*b* by the connecting bars 155. The position where the upper ends of the link members 23*a* and 23*b* are pivotally connected to the link connecting rod 213 is not restricted if the position belongs to the upper side of the pivot shaft 214 of the connecting rods 212*a* and 212*b*. However, it is preferable that the installation position is far from the pivot shaft 214 for the purpose of smooth operation.

Also, the back support 20 includes the sliding frame 25 which is slid along the support rods 211*a* and 211*b* in the vertical direction, connecting rods 26 which are connected to the lower portion of the sliding frame 25, with lower ends of the connecting rods 26 being restrained to the base plate 11 by pin connection at a forward position relative to the lower end of the back frame 21, and spring members 27 which are installed to the sliding frame 25 and the upper end connecting rod 211*c* at both ends to pull the sliding frame 25 toward the upper end connecting rod 211*c*.

The sliding frame 25 is slid along the support rods 211*a* and 211*b* in the vertical direction, and has pairs of rollers 251 and 252, which are brought into contact with the support rods 211*a* and 211*b*, at upper and lower sides thereof.

Figure 6:
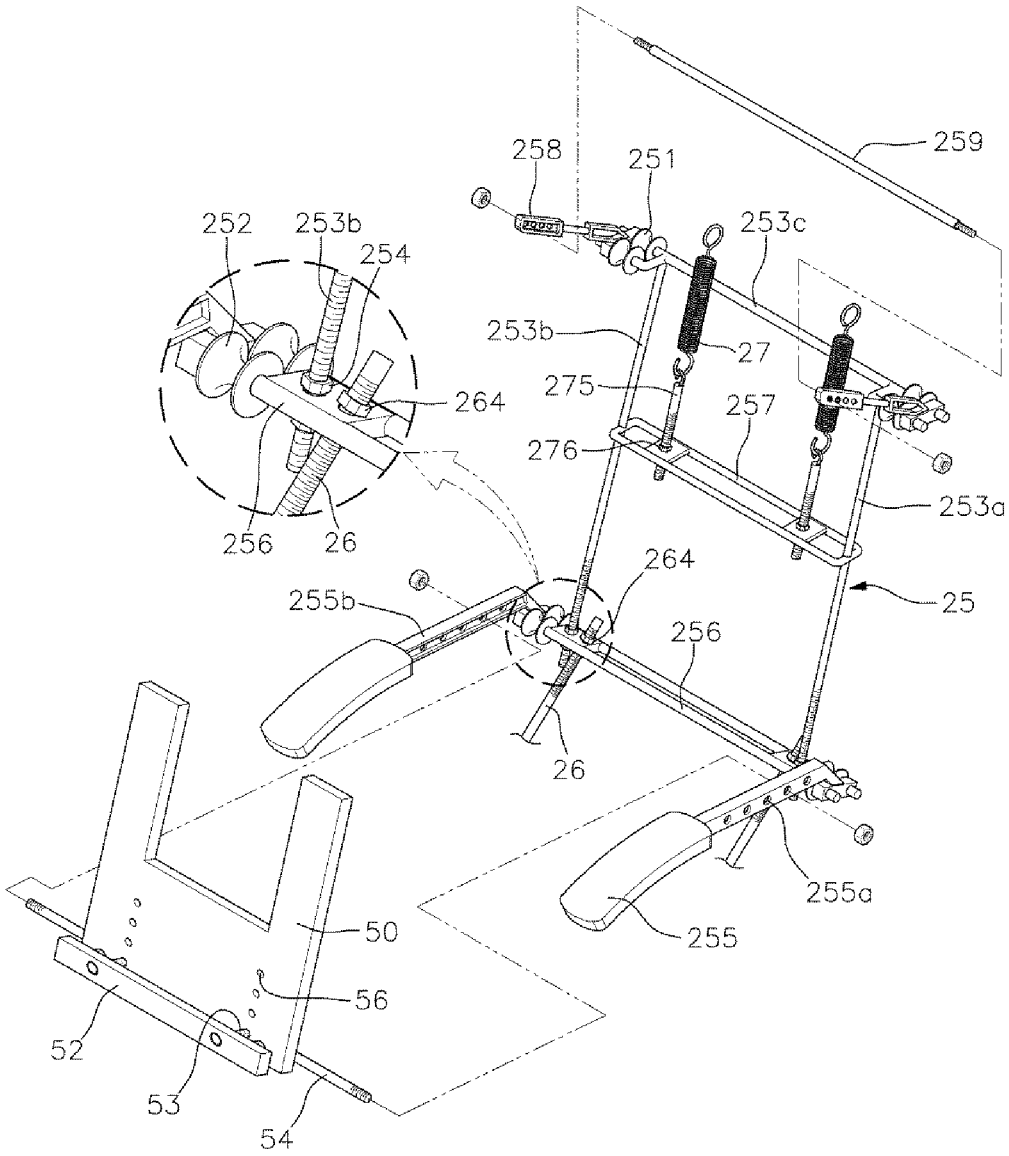
FIG. 6 is a perspective view illustrating the configuration of a sliding frame in the chair capable of interlocking the back support and the footrest according to one embodiment of the present invention.

FIG. 2 shows the assembled state of the sliding frame 25, and FIG. 6 is a perspective view illustrating the configuration of the sliding frame 25.

Referring to FIGS. 2 and 6, the sliding frame 25 has vertical connecting bars 253*a* and 253*b* which stand in parallel at both sides thereof, an upper connecting bar 253*c* for horizontally connecting upper ends of the vertical connecting bars 253*a* and 253*b*, a spring supporting member 257 for connecting intermediate portions of the vertical connecting bars 253*a* and 253*b*, and a lower connecting bar 256 for horizontally connecting lower ends of the vertical connecting bars 253*a* and 253*b* so as to adjust connecting positions of the vertical connecting bars 253*a* and 253*b*.

The upper connecting bar 253*c* is integrally fixed to the vertical connecting bars 253*a* and 253*b*, and both sides of the upper connecting bar 253*c* are provided with a roller 251 which can slide along the support rods 211*a* and 211*b*. A headrest hanger 258 is installed to an outside of each roller 251.

The spring supporting member 257 integrally connects the intermediate portions of both vertical connecting bars 253*a* and 253*b*, and resilience adjusting rods 275 are connected to the spring supporting member 257 to support the lower ends of the springs 27. The resilience adjusting rod 275 is formed with a male threaded portion, and thus can be fixed by a nut 276 in a state in which the resilience adjusting rod 275 is inserted into a groove formed in the spring support member 257. After the nut 276 is unfastened, the height of the resilience adjusting rod 275 is adjusted, and then the nut 276 is again fastened, thereby adjusting the resilience of the spring member 27.

The lower connecting bar 256 is connected to the lower ends of both vertical connecting bars 253*a* and 253*b*, and is fixed to the lower ends thereof by fastening nuts 254 to threaded portions formed on the lower ends of the vertical connecting bars 253*a* and 253*b*. Accordingly, after the nuts 254 is unfastened, the connecting position between both vertical connecting bars 253*a* and 253*b* and the lower connecting bar 256 is vertically adjusted, and then the nuts are again fastened.

Both sides of the lower connecting rod 256 are provided with the rollers 252 which can move along the support rods 211*a* and 211*b*, and armrests 255 are installed at outside of the rollers 252. The armrests can move together with the lower connecting rod 256.

Since the length of the lower end of both vertical connecting rods 253*a* and 253*b* to be inserted into the lower connecting rod 256 is adjusted by unfastening the nuts 254, an interval between a lumbar support 52 connected to an armrest support 255*b* which will be described later, and a cervical spine support 259 of the headrest hanger 258 which integrally moves together with the vertical connecting bars 253*a* and 253*b* can be adjusted, thereby adjusting the chair to be suitable for a body type of the user (distance between a lumbar and a cervical spine).

The connecting rod 26 is configured to restrain the sliding frame 25 from moving relative to the seat support 10. The lower end of the connecting rod 26 is pivotally connected to the seat frame 17 by a bracket 263. The connecting rod 26 is pivotally connected at a position in front of the lower end of the back frame 21. However, since the connection is for the purpose of restraining the connecting rod from moving relative to the base plate 11, the connecting rod can be directly pivotally connected to the base plate 11.

The connecting portion between the connecting rod 26 and the sliding frame 25 is provided with an adjuster for adjusting the position of the connecting rod 26 to be connected to the sliding frame 25. Preferably, the adjuster consists of a threaded portion formed on the upper portion of the connecting rod 26 or the entire connecting rod 26, and a nut 264 which is threadedly engaged with the threaded portion. The lower portion of the sliding frame 25 can be engaged with the upper portion of the connecting rod 26 by engagement of the threaded portion and the nut 264, and the engaging position of the connecting rod 26 to be engaged with the sliding frame 25 can be adjusted by unfastening/fastening the nut 264. The position of the sliding frame 25 can be adjusted in the vertical direction by the adjustment of the engaging position, thereby adjusting the height of the sliding frame 25 supporting an upper body of the user depending upon the body type of the user.

Also, the upper end of the connecting rod 26 is simply inserted into a hole formed in the lower connecting rod 256 of the sliding frame 25, and then is fixed by the nut 264, so that the connecting rod 26 can be slightly moved with respect to the sliding frame 25, for example, slight tilting.

Figure 7A:
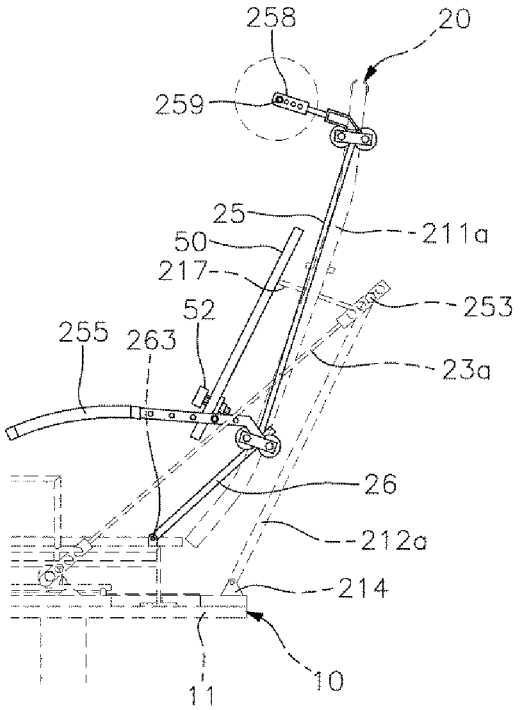
FIG. 7A and FIG. 7B are views illustrating the operation of the sliding frame in the chair capable of interlocking the back support and the footrest according to one embodiment of the present invention.
Figure 7B:
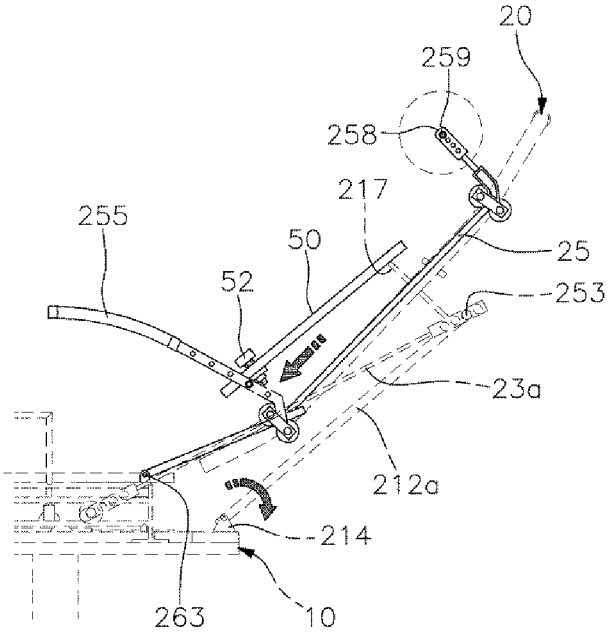

Referring to FIGS. 7A and 7B, since the sliding frame 25 is restrained from moving relative to the base plate 11 by the connecting rod 26, when the back frame 21 is tilted in the rearward direction about the pivot shaft 214, the back frame 21 is pulled by the connecting rod 26, and thus the sliding frame 25 is relatively slid on the support rods 211*a* and 211*b*. Even though the back support 20 is tilted in the rearward direction, the sliding frame 25 is relatively slid in the downward direction, thereby maintaining the state of supporting the upper body of the user. That is, since the back plate 50 and the lumbar support 52 do not operate with the back frame 21, but operate with the sliding frame 25. Even when the back support 20 is tilted in the rearward direction, the position of the back plate 50 and the lumbar support 52 to support the upper body of the user is little changed.

More specifically, when the back support 20 is tilted in the rearward direction in the common chair, the upper body of the user occupying the chair is turned about his or her waist, and the back support 20 is turned around the pivot shaft 214 which is behind the base plate 11, so that the center of rotation is different from each other. Accordingly, slipping happens between the user's back and the back support 20 in the process of tilting the back support 20, and thus the region of the back support 20 which is brought into contact with the upper body of the user is changed in the process of tilting the back support 20. There is a problem in that the user does not feel comfort in the state in which the back support 20 is completely tilted, as compared to the upstanding state of the back support 20. The sliding frame 25 solves the above problem. That is, the positions of the back plate 50 supporting the upper body of the user and the lumbar support 52 are little changed relative to the upper body of the user between the upstanding state and the tilting state of the back support 20. The back plate 50 and the lumbar support 52 continuously maintain the position to support the upper body of the user.

Both ends of the spring member 27 are connected to the sliding frame 25 and the upper end connecting rod 211*c* so as to pull the sliding frame 25 toward the upper end connecting rod 211*c*. Therefore, when the back support 20 is tilted in the rearward direction, and the sliding frame 25 is slid relative to the support rods 211*a* and 211*b*, the spring member 27 is pulled and tensioned to generate the resilience. The sliding frame 25 is pulled toward the upper end connecting rod 211*c* by the resilience, and also the resilience serves as a restoring force to return the tilted back frame 21 to its original position so that the sliding frame 25 can approach the upper end connecting rods 211*c*.

The sliding frame 25 is provided with the armrests 255 at both sides thereof so that the user puts his or her arms on the armrests. More specifically, both armrests 255 are installed to both sides of the lower connecting rods 256 of the sliding frame 25 by the armrest supports 255*b*. Accordingly, as shown in FIGS. 7*a* and 7*b*, both armrests 255 can be moved together with the sliding frame 25.

The reason why the armrests 255 are not fixed to the seat support 10, but are engaged to the sliding frame 25 is that it maintains the posture of the upper body and arms of the user in the states in which the back support 20 is tilted in the rearward direction and in which the back support 20 is returned to its original position. That is, since the armrests 255 are moved together with the sliding frame 25 in the states in which the back support 20 is tilted in the rearward direction and in which the back support 20 is returned to its original position, the distance between the upper body of the user and the armrest 255 and the angle (a in FIG. 8) between the upper body and the armrest 255 are constantly maintained, so that the user feels comfort.

The armrest support 255*b* of the respective armrests 255 is formed with a plurality of engaging slots 255*a* so that the back plate 50 for supporting the user's back is connected to the armrests 255. An engaging rod 54 of the back plate 50 is selectively inserted and fixed to any engaging slot 255*a*. The fixed position of the back plate 50 is determined according to the position of the selected engaging slot 255*a*.

Also, the back plate 50 is formed a plurality of installation holes 56 in a vertical direction, and the lumbar support 52 is fixed to the installation hole 56 in a horizontal direction, and thus is fixed to the lower portion of the back plate 50. The installation height of the lumbar support 52 can be determined by selecting the installation holes 56 arranged in the vertical direction according to the body type of the user.

The headrest hangers 258 are installed to the upper portion of the sliding frame 25, and then are moved together with the sliding frame 25. Both headrest hangers 258 are formed with a plurality of engaging slots, and thus the cervical spine supports 259, to which a headrest is installed, may be fixed to the headrest hangers 258.

Figure 8:
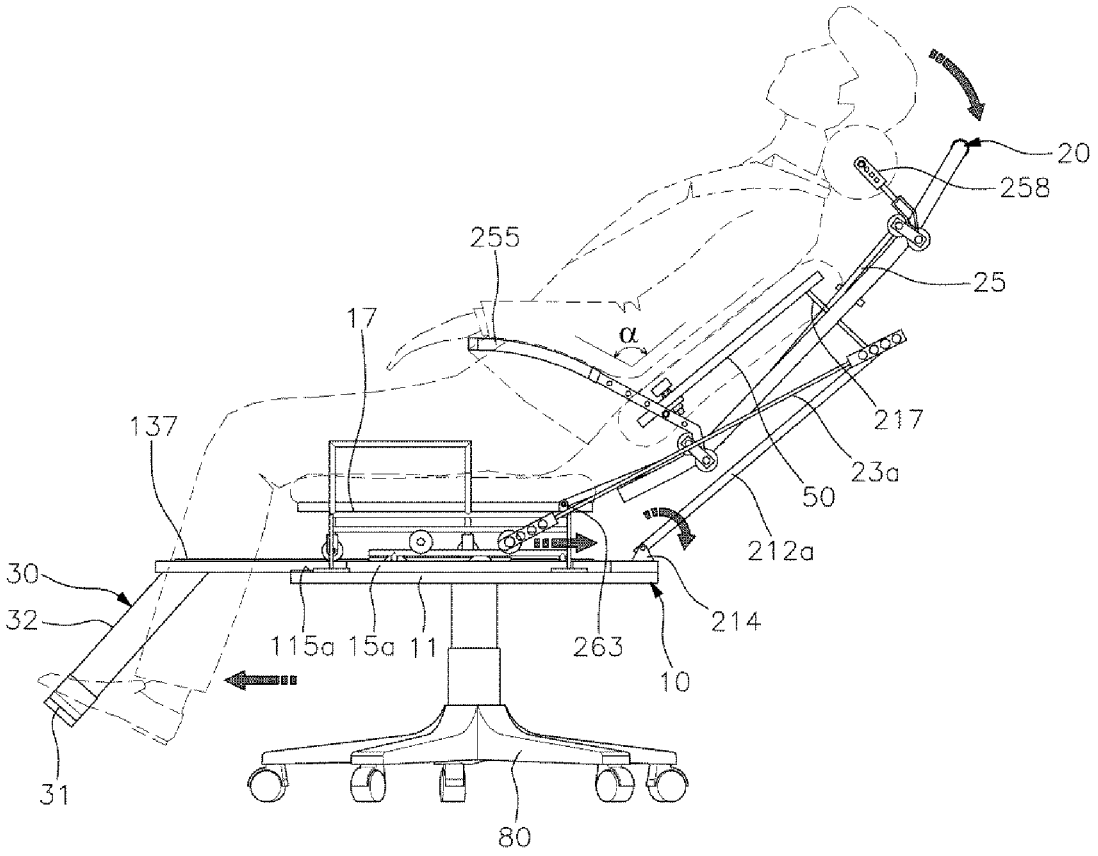
FIG. 8 is a view illustrating a state in which a user occupies the chair capable of interlocking the back support and the footrest according to one embodiment of the present invention.

FIG. 8 shows the use state of the chair according to the present invention, in which the back support 20 and the footrest 30 are interlocked to each other.

Before the user takes a seat, the engaging position between the lower ends of both vertical connecting bars 253*a* and 253*b* and the lower connecting bar 256 is adjusted by unfastening the nut 254. Thus, the interval between the lumbar support 52 engaged to the armrest 255 and the cervical spine supports 259 of the headrest hangers 258 which move together with the vertical connecting bars 253*a* and 253*b* can be adjusted to be suitable for the body type of the user.

After that, the length of the connecting rod 26 to be engaged with the sliding frame 25 is adjusted by unfastening the nut 264 which engages the lower connecting bar 256 and the upper portion of the connecting rod 26. This adjusts the vertical position of the sliding frame 25, and the positions of the back plate 50 and the cervical spine support 259 are determined according to the length of the connecting rod 26.

After the above adjustment is completed, the user sits down on the seat support 10, and puts his or her feet on the foot strap 31 in the state in which the upper body of the user is supported by the back support 20. In this instance, the spring member 27 generates the resilience to pull the sliding frame 25 toward the upper end connecting rod 211*c*. Therefore, the back support 20 is not easily tilted in the rearward direction, and the footrest 30 which is interlocked with the back support 20, the first sliding member 13, the second sliding members 15*a* and 15*b*, and so forth is not easily moved in the forward direction.

In this instance, as illustrated in FIG. 8, if the user stretches his or her legs to pull the footrest 30 in the forward direction, and applies the weight of the upper body to the rear portion, the first sliding member 13 engaged to the footrest 30 moves forward, and the second sliding members 15*a* and 15*b* are slid in the rearward direction as the first sliding member 13 moves forward. And, the lower ends of the link members 23*a* and 23*b* which are pivotally engaged to the second sliding members 15*a* and 15*b* are also moved in the rearward direction.

Simultaneously, the back support 20 receives the load applied from the upper body of the user, and the force of tilting the back support in the rearward direction by the pushing of the link members 23*a* and 23*b*, so that the back support can be tilted in the rearward direction against the resilience.

In order to return the back support 20 to its original position, if the user raises his or her upper body and pulls his or her feet, the lower ends of the link members 23*a* and 23*b* move forward, and, at the same time, the back frame 21 is returned by the resilience which tends to approach the sliding frame 25 and the upper end connecting rod 211*c*. Therefore, the back support 20 can be easily returned.

Also, in the process of tilting the back support 20 in the rearward direction, if the user's legs adjust movement of the foot strap 31, it is possible to adjust a slope of the back support 20.

With the configuration of the chair according to the present invention, the user simultaneously bends his or her upper body in the rearward direction and stretches his or her legs, and the change of the posture leads to cooperation of the load applied from the bending upper body of the user, and the force of pushing the foot strap 31.

Since the tilting movement of the back support 20 and the forward movement of the footrest 30 occurs concurrently, the user can quickly change his or her sitting posture to the comfortable posture in which the feet are stretched and the upper body is bent in the rearward direction.

Figure 9:
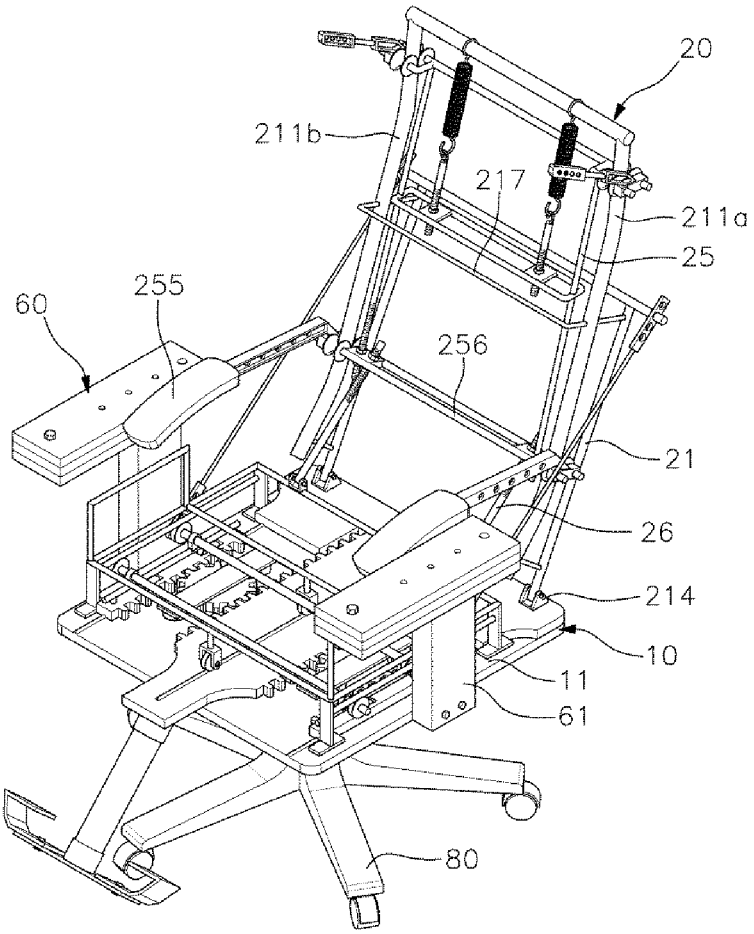
FIG. 9 is a view illustrating a reading desk support which is provided to the chair capable of interlocking the back support and the footrest according to one embodiment of the present invention.
Figure 10:
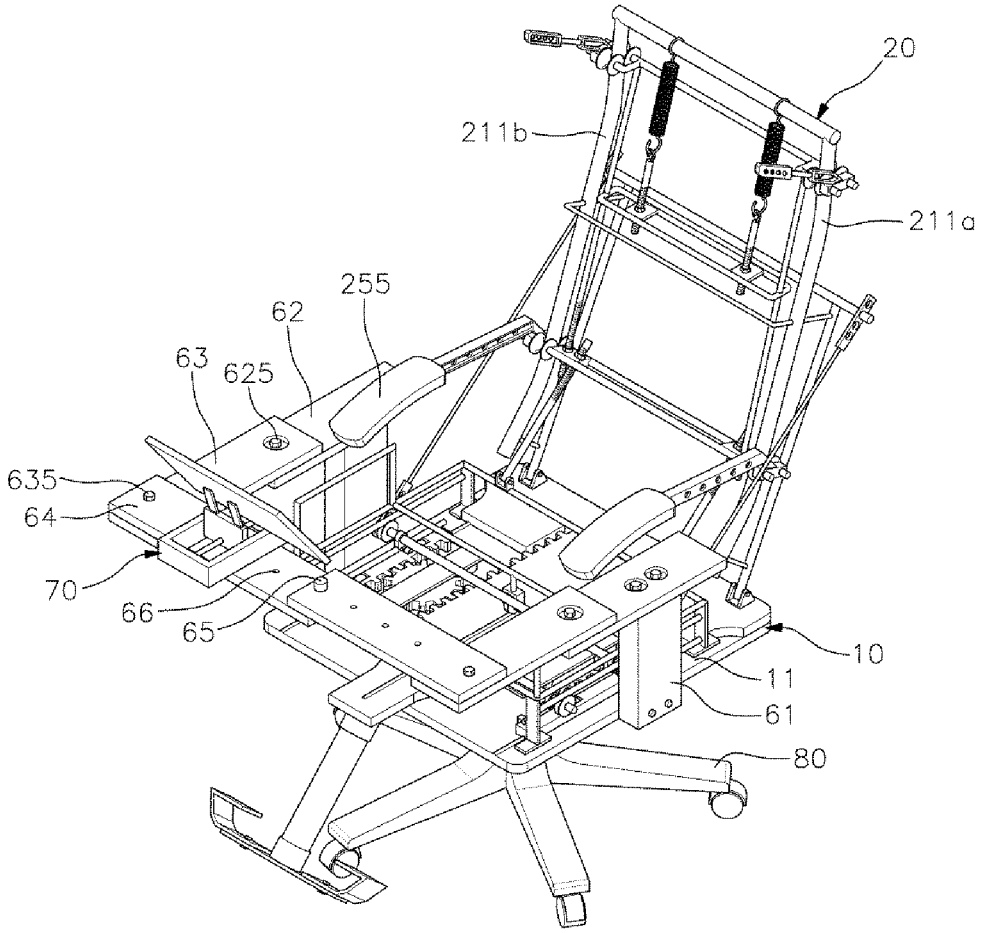
FIG. 10 is a view illustrating an unfolded state of the reading desk support in FIG. 9.

Meanwhile, FIGS. 9 and 10 show the configuration of the chair according to one embodiment of the present invention which is provided with a reading desk support 60.

Referring to FIG. 9, the reading desk support 60 is installed to both sides of the seat support 10, and includes a standing support member 61 with a lower end fixed to the seat support 10, and a three-stage link board installed to an upper end of the support member 61, respectively.

The three-stage link board is arranged in such a way that a longitudinal direction thereof faces a forward/rearward direction, and has a first-stage link board 62 which is fixed to the upper end of the support member 61, a second-stage link board 63 with one end pivotally connected to a first link shaft 625 which is installed to a front end of the first-stage link board 62, and a third-stage link board 64 with one end pivotally connected to a second link shaft 635 which is installed to the other end of the second-stage link board 63.

According to the respective reading desk supports 60, the three-stage link board is unfolded about the first link shaft 625 and the second link shaft 635, and thus the third-stage link board 64 is positioned in front of the user, as illustrated in FIG. 10.

The third link boards 64 of both reading desk supports 60 can be connected to each other by inserting a pin 65 into through-holes formed in the ends thereof, as illustrated in FIG. 9.

The third link boards 64 which are unfolded in front of the user are formed with a plurality of through-holes 66 at desired intervals. A reading desk 70 can be positioned at a proper position, and then can be fixed to the third link board 64 by inserting a pin (not illustrated) into the reading desk 70 and the third link board 64.

The present invention can be applied to domestic or office chairs in order to provide the user with comfort, and thus can be usefully employed in industries related to the chair.

What is claimed is:

1. A chair capable of interlocking a back support and a footrest, the chair comprising:

a seat support;

a back support which has a back frame, with a lower end being connected to a rear end of the seat support by a pivot shaft, so that the back support is tilted in a rearward direction; and a footrest which is engaged to the seat support, the seat support including a base plate, a first sliding member which is slid back and forth on the base plate and is provided with first rack gears in a sliding direction, intermediate gears which have rotating shafts installed to the base plate and are meshed with the first rack gears, and second sliding members which are slid back and forth on the base plate and are provided with second rack gears to be meshed with the intermediate gears so that the second sliding members are slid in a direction opposite to the first sliding member, the footrest including a foot strap which is engaged to a front end of the first sliding member, and is positioned below a front portion of the seat support, and the back support including link members which are installed at sides of the seat support, with upper ends of the link members being pivotally connected to the back frame at an upper side of the pivot shaft, and lower ends thereof being pivotally connected to the second sliding members.

2. The chair capable of interlocking the back support and the footrest according to claim 1, wherein the back frame has a pair of support rods which are disposed in parallel at both sides of the back support in a vertical direction, and an upper end connecting rod for connecting upper ends of the pair of support rods, wherein the back support includes a sliding frame which is slid along the support rods in a vertical direction, connecting rods which are connected to a lower portion of the sliding frame, with lower ends of the connecting rods being restrained to the base plate by pin connection at a forward position relative to a lower end of the back frame, and spring members which are installed to the sliding frame and the upper end connecting rod at both ends thereof to pull the sliding frame toward the upper end connecting rod.

3. The chair capable of interlocking the back support and the footrest according to claim 2, wherein the base plate is provided with a plurality of rollers which is brought into contact with a bottom surface of the first sliding member to assist sliding movement of the first sliding member, and wherein a top surface of the base plate is provided with rails in a longitudinal direction so that the second sliding members are moved back and forth along the rails, and a stopper for restricting rearward movement of the first sliding member within a preset range.

4. The chair capable of interlocking the back support and the footrest according to claim 2, wherein the sliding frame is provided with a back plate for supporting an upper body of a user, and armrests installed to both sides of the sliding frame, and the back plate and the armrests are moved together with the sliding frame.

5. The chair capable of interlocking the back support and the footrest according to claim 2, wherein a connecting portion between the connecting rod and the sliding frame is provided with an adjuster for adjusting a position of the connecting rod to be connected to the sliding frame, thereby adjusting a height of the sliding frame.

6. The chair capable of interlocking the back support and the footrest according to claim 1, wherein a reading desk support is respectively installed to both sides of the seat support, and includes a standing support member with a lower end fixed to the seat support, and a three-stage link board installed to an upper end of the support member, wherein the three-stage link board is arranged in such a way that a longitudinal direction thereof faces a forward/rearward direction, and has a first-stage link board which is fixed to the upper end of the support member, a second-stage link board with one end pivotally connected to a first link shaft which is installed to a front end of the first-stage link board, and a third-stage link board with one end pivotally connected to a second link shaft which is installed to the other end of the second-stage link board, and wherein the third link board of the respective reading desk supports is formed with a plurality of through-holes at desired intervals.

7. A chair capable of interlocking a back support and a footrest, the chair comprising:

a seat support;

a back support which has a back frame, with a lower end being connected to a rear end of the seat support by a pivot shaft, so that the back support is tilted in a rearward direction; and a footrest which is engaged to the seat support, the seat support including a base plate, a first sliding member which is slid back and forth on the base plate, and second sliding members which are interlocked with the first sliding member and are slid back and forth on the base plate so that the second sliding members are slid in a direction opposite to the first sliding member, the footrest including a foot strap which is engaged to a front end of the first sliding member, and is positioned below a front portion of the seat support, and the back support including link members which are installed at sides of the seat support, with upper ends of the link members being pivotally connected to the back frame at an upper side of the pivot shaft, and lower ends thereof being pivotally connected to the second sliding members, wherein the back frame has a pair of support rods which are disposed in parallel at both sides of the back support in a vertical direction, and an upper end connecting rod for connecting upper ends of the pair of support rods, wherein the back support includes a sliding frame which is configured to support an upper body of a user and is slid along the support rods in a vertical direction, connecting rods which are connected to a lower portion of the sliding frame, with lower ends of the connecting rods being restrained to the base plate by pin connection at a forward position relative to a lower end of the back frame, and spring members which are installed to the sliding frame and the upper end connecting rod at both ends thereof to pull the sliding frame toward the upper end connecting rod.

* * * * *